United States Patent [19]

Staples

[11] Patent Number: 4,569,167

[45] Date of Patent: Feb. 11, 1986

[54] MODULAR HOUSING CONSTRUCTION SYSTEM AND PRODUCT

[76] Inventor: Wesley Staples, P.O. Box 149, Palatka, Fla. 32077

[21] Appl. No.: 503,354

[22] Filed: Jun. 10, 1983

[51] Int. Cl.[4] ..... E04C 1/10

[52] U.S. Cl. ..... 52/90; 52/285; 52/293; 52/295; 52/584; 52/766

[58] Field of Search ..... 52/578, 580, 581, 582, 52/583, 584, 585, 586, 587, 236.6, 283, 285, 299, 639, 642, 644, 766, 295, 293, 90; 403/374; 411/354, 355; 211/192

[56] References Cited

U.S. PATENT DOCUMENTS

| | | | |
|---|---|---|---|
| 1,506,442 | 8/1924 | O'Hara | 52/766 |
| 1,540,542 | 6/1925 | Carhart | 52/578 |
| 2,139,623 | 12/1938 | Marston | 52/236.6 |
| 2,140,772 | 12/1938 | Slayter et al. | 52/580 |
| 2,443,949 | 6/1948 | Cohen | 403/374 |
| 2,467,115 | 4/1949 | Duggan | 52/699 |
| 2,862,254 | 12/1958 | Meek | 52/578 |
| 2,947,119 | 8/1960 | Puckett, Jr. | 52/699 |
| 3,011,228 | 12/1961 | Driggs | 52/285 |
| 3,122,223 | 2/1964 | Chell et al. | 198/781 |
| 3,144,701 | 8/1964 | Bowden | 52/582 |
| 3,567,260 | 3/1971 | Norris | 52/127.11 |
| 3,851,428 | 12/1974 | Shuart | 52/583 |
| 3,897,663 | 8/1975 | Gaul | 52/283 |
| 3,958,954 | 5/1976 | Ehlenbeck | 52/583 |
| 4,018,021 | 4/1977 | Dow | 52/583 |
| 4,027,439 | 6/1977 | Willard | 52/299 |
| 4,045,927 | 9/1977 | Diaz | 52/127 |
| 4,057,948 | 11/1977 | Wise | 52/582 |
| 4,228,986 | 10/1980 | Schimmel et al. | 403/374 |
| 4,272,930 | 6/1981 | Foster | 52/79.1 |
| 4,329,826 | 5/1982 | Flogaus et al. | 52/712 |
| 4,386,486 | 6/1983 | Holt et al. | 52/716 |

FOREIGN PATENT DOCUMENTS

| | | | |
|---|---|---|---|
| 2149991 | 4/1973 | Fed. Rep. of Germany | 52/126.7 |
| 683562 | 2/1965 | Italy | 52/583 |
| 783430 | 11/1980 | U.S.S.R. | 52/587 |

*Primary Examiner*—John E. Murtagh
*Assistant Examiner*—Andrew Joseph Rudy
*Attorney, Agent, or Firm*—Kerkam, Stowell, Kondracki & Clarke

[57] ABSTRACT

A modular housing construciton consists of pre-cast concrete footer/foundation components; modular floor panel elements; interior/exterior modular wall panel units; and a roof. The floor panel elements, wall panel units, and foundation components have preformed wedge/lock receiving openings and the pre-cast concrete footer/foundation components and the wall panel units have preformed wedge-lock operating openings provided therein. Certain of the wall panel units are provided with windows and certain of the wall panel units are provided with doors. Electrical receptacle and wiring are fabricated in selected wall panel units. The wall panel units, the floor panel units and footer/foundation components are preferably preformed in four foot sections whereby the size of the housing is determined by the selected number of such units. With the modular form of construction on the site erection and diassembly of the footer/foundation components, floor panel elements, wall panel units and roofing is minimized and quality control is standardized.

4 Claims, 18 Drawing Figures

FIG. 2.
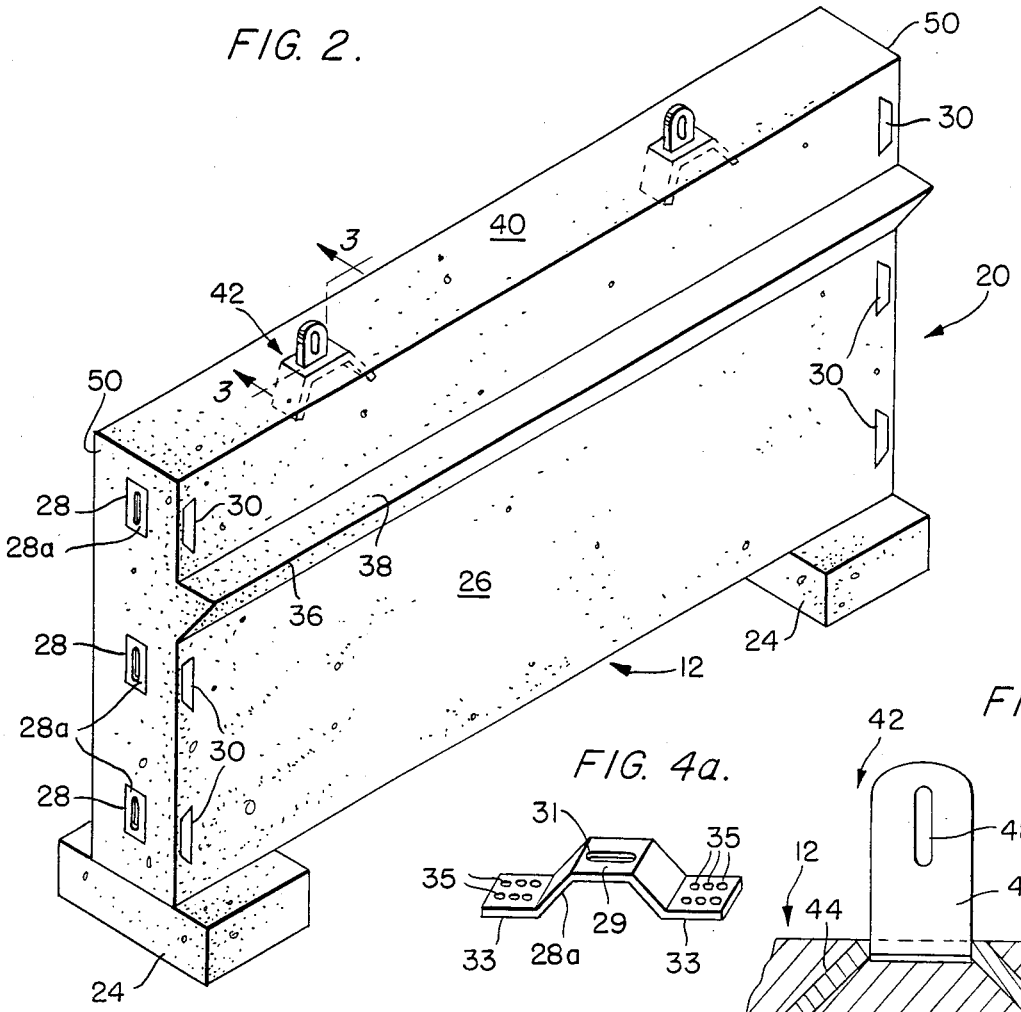
FIG. 4a.
FIG. 3.
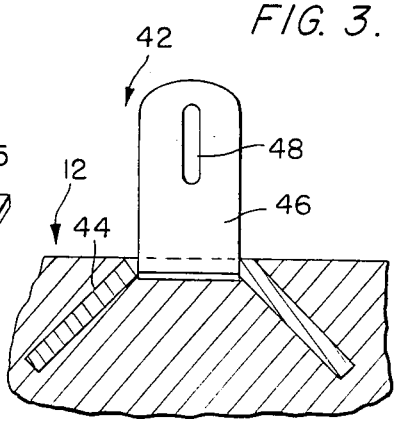
FIG. 4.
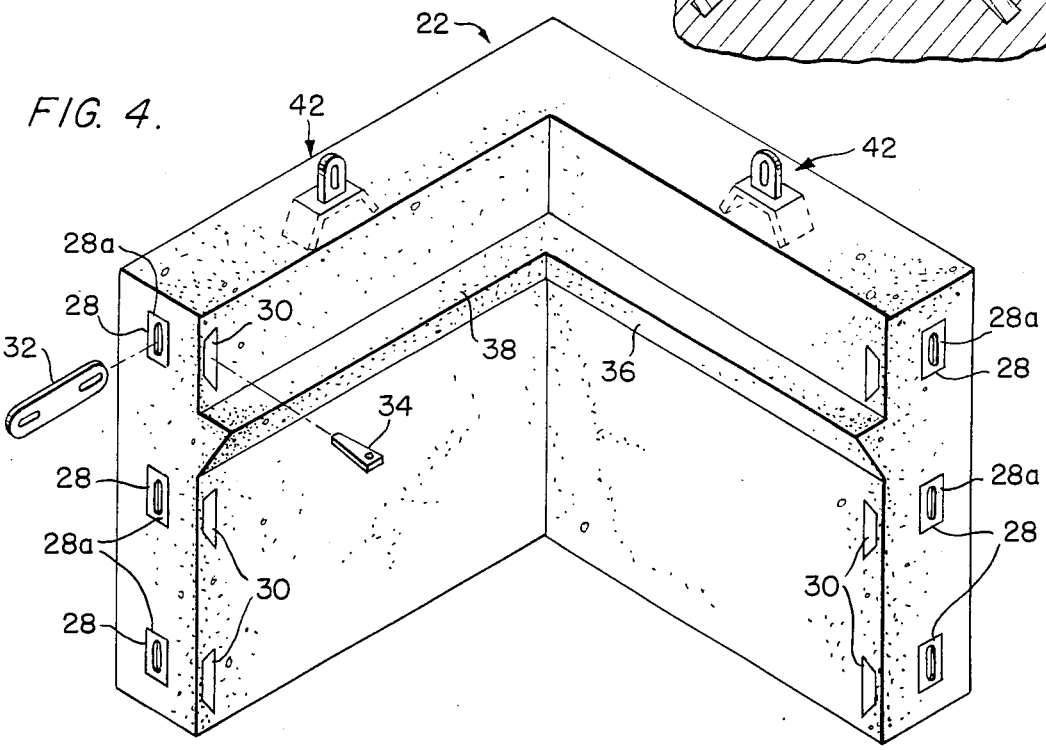

MODULAR HOUSING CONSTRUCTION SYSTEM AND PRODUCT

TECHNICAL FIELD

This invention relates to modular housing construction system of the type in which all basic components of the building are prefabricated at a factory or shop and simply erected at the site with a minimum of on-the-site construction.

BACKGROUND OF THE PRIOR ART

With the cost of labor, materials and financing in an upward spiral, conventional home construction has become out of reach of many people in the home buying market, such as families of limited income and basically little cash, and families on retirement income. Further, even where the high cost of conventional new home construction can be met, the waiting period for completion of conventional new home construction has often resulted in loss of purchasers to the mobile home market, which represented about 80% of new home sales in the State of Florida in 1980.

In the past, it has been the custom in manufacture of modular homes that the homes are built in, for example, two parts or sections, moved to the desired site or location in halves which are placed onto conventional foundation means and the two halves joined. It normally takes a crew four or five days to complete the construction on site.

It is also known to prefabricate housing components for erection at the site and representative of such prior art is found in U.S. Pat. No. 3,122,223 Chell et al. and U.S. Pat. No. 2,140,772 Slayter et al.

BRIEF SUMMARY OF THE INVENTION

It is a principle object of the present invention to construct in a controlled environment concrete footer/-foundation components; modular floor panel elements; and interior/exterior module wall panel units where the quality and cost of both labor and materials can be closely controlled. The modular components can be manufactured at a much lower cost at a factory environment with the use of jigs, pneumatic clamps, nail guns, and other techniques of automation. It has also been found that relatively low cost labor can be used which labor can become proficient by the repititious building of similar components in an environment where weather is not a factor.

It is a further object to provide a housing system wherein a component inventory is established and from the component inventory it is possible to design and select components to a customer's requirements, only limited to the extent of four foot increments which form the basic size of the major modular units.

After selecting the desired components, they are delivered to a site where erection crews or the home owners themselves erect the house via an assembly sheet. It is projected that a home of medium size could be erected on site ready for occupancy in, for example, 150 man hours.

A further object of the present invention is to provide such a modular housing construction system that should the owners desire to move the assembled house, dissassembly thereof can be achieved without destruction of the components.

BRIEF DESCRIPTION OF THE DRAWINGS

The invention will be more fully described in reference to the accompanying drawings wherein:

FIG. 2 is a perspective view of one precast concrete footer/foundation component;

FIG. 3 is a section on line 3—3 of FIG. 2;

FIG. 4 is a perspective view of a precast concrete footer/foundation corner component;

FIG. 4*a* is a perspective view of a wedge lock bracket for the foundation components;

DETAILED DESCRIPTION OF THE PREFERRED EMBODIMENT

Figure 1:
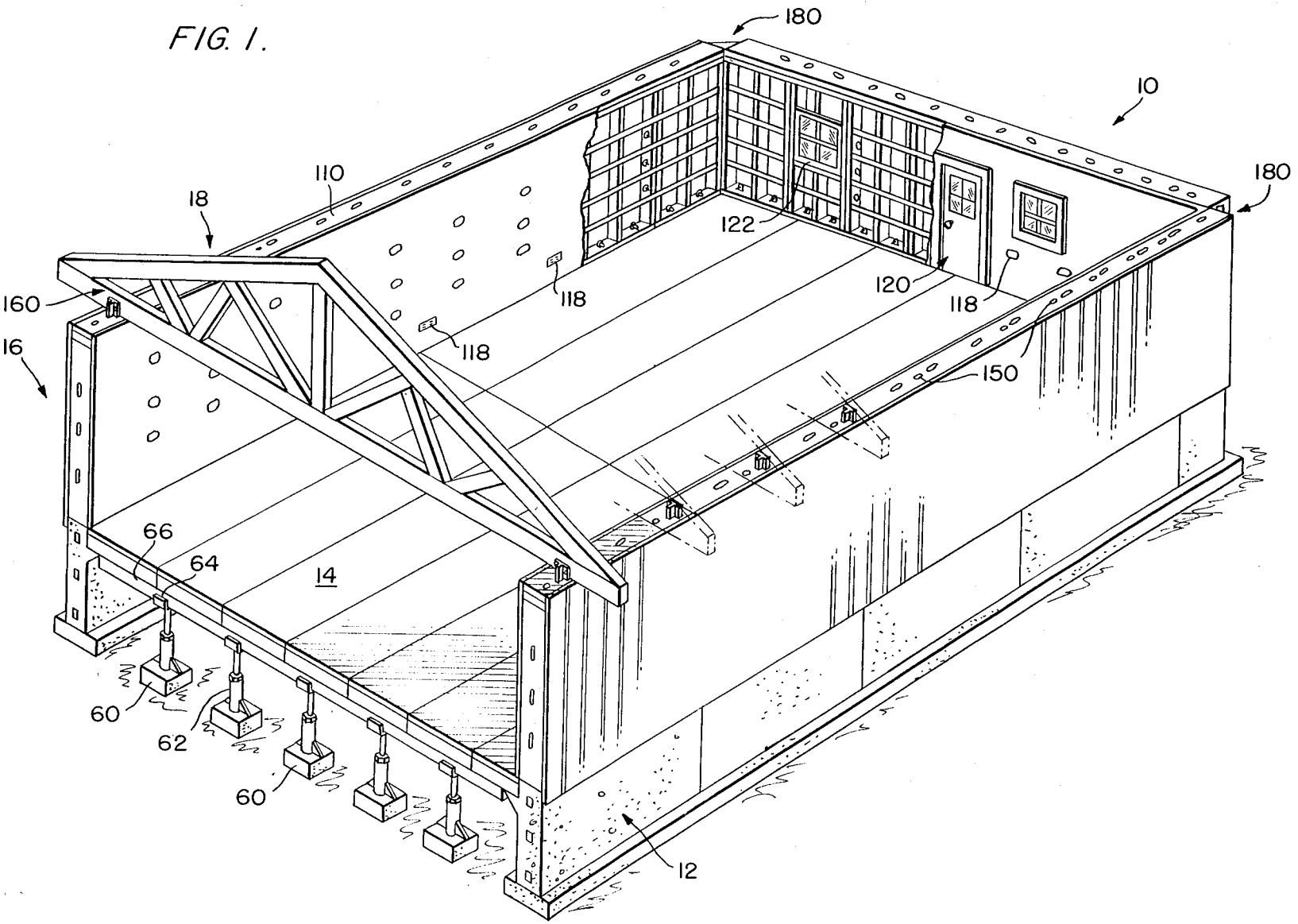
FIG. 1 is a fragmentary partial perspective view of a modular housing unit constructed in accordance with the teachings of the present invention.

Referring to the drawing and in particular to FIG. 1 thereof, 10 generally designates a modular housing constructed in accordance with the teachings of the present invention. The modular housing is formed from a number of primary modulars including pre-cast concrete footer/foundation units 12, modular floor panel elements 14, interior/exterior modular wall panel units 16 and roof trusses 18. These various modular units will be described separately and in greater detail hereinafter.

Referring now particularly to FIGS. 2 through 4, the modular pre-cast concrete footer/foundation components 12 are of two forms. The first form, illustrated in FIG. 2, is for longitudinal side walls and is designated 20 and the other form is a longitudinal/corner wall forming member 22, illustrated in FIG. 4.

Each unit 20 consists of footers 24 and vertical wall sections 26. In forming these elements 20 and their counterpart units 22, conventional reinforced concrete casting procedures are followed.

At each end of unit 20 are a plurality of openings 28 which communicate with interior openings 30. The openings 28 and 30 receive wedge bars 32 as shown in FIG. 4 and wedge lock pins 34. In a preferred embodiment, each module 20 is 4 feet in length, 2 feet high, and $5\frac{1}{2}$ inches in thickness.

Along the inner wall is cast an inwardly projecting ledge 36, the top surface 38 of which is six inches below the top surface of the foundation components. The ledges are adapted to receive the floor panel modules as to be more fully described hereinafter. In the upper surface 40 of the foundation elements are cast wedge lock elements 42 more clearly illustrated in FIG. 3. The wedge lock elements 42 consist of a lazy U shaped metal element 44 having welded thereto an upright member 46 provided with an elongated slot 48 to receive one of the wedges 34. In a preferred embodiment two of the elements 42 are cast in each foundation unit 20 with the centers of the elements 42 positioned twelve inches from the closest side wall 50 of the foundation.

The corner foundation element 22 is pre-cast following reinforcing concrete casting procedures and each corner element is provided with openings such as openings 28 and 30, FIG. 2 and with wedge lock elements such as wedge lock elements 42, FIGS. 2 and 3 of the drawings. Each of the foundation units 20 and 22 may have cast in each of the openings 28 a bracket element as shown in FIG. 4*a* and at 28*a* in FIG. 4. The elements 28*a* help to stabilize the tie bars and the foundation from lateral displacement whereas the wedges 34 prevent longitudinal displacement of the foundation elements.

The bracket 28*a* in the bridge portion 29 is provided with elongated slot 31 adapted to receive one of the tie bars 32 or 32'. Each of the legs 33 of the bracket 28*a* is provided with a plurality of openings 35 which assist in anchoring the bracket in the concrete foundation either at the time of casting or subsequent thereto through the use of a suitable adhesive.

Figure 5:
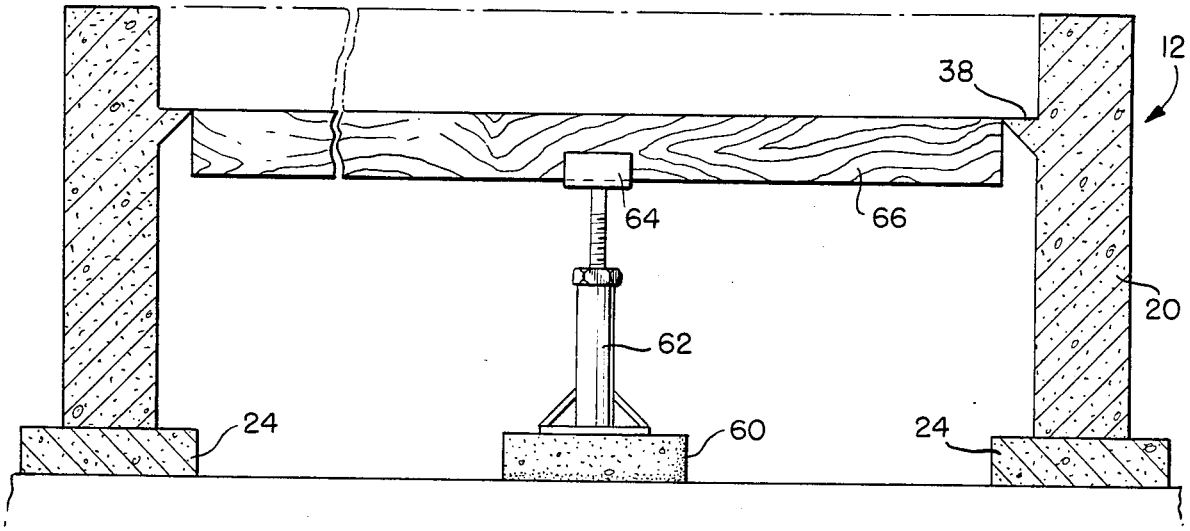
FIG. 5 is a vertical sectional view of a pair of footer/-foundation components and support means for a modular floor.
Figure 7:
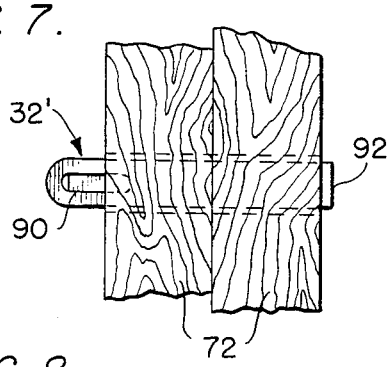
FIG. 7 is a fragmentary view of the wedge lock system in operation.
Figure 8:
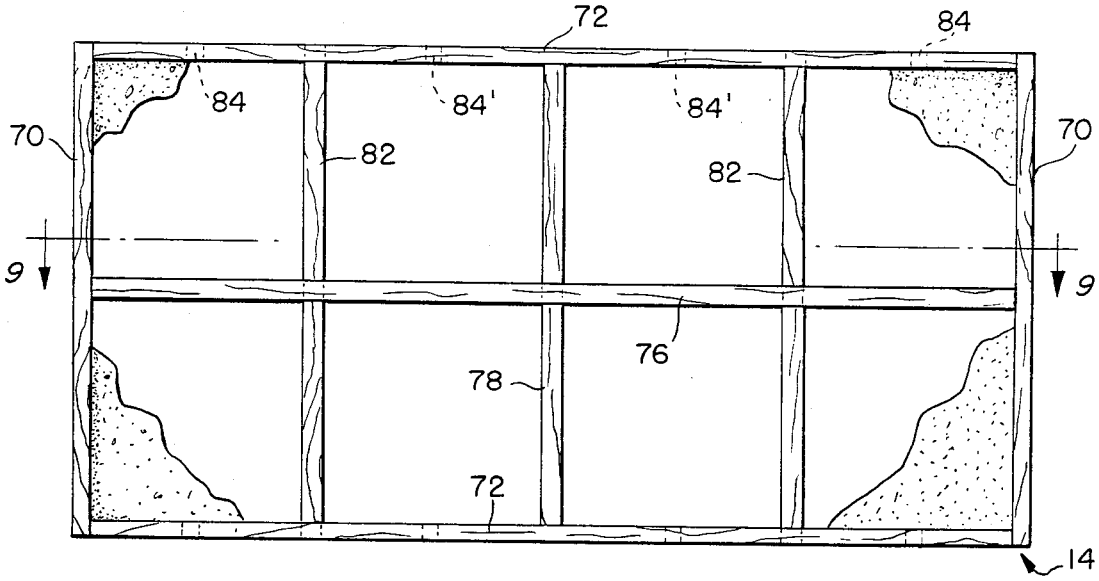
FIG. 8 is a modular floor unit.
Figure 9:
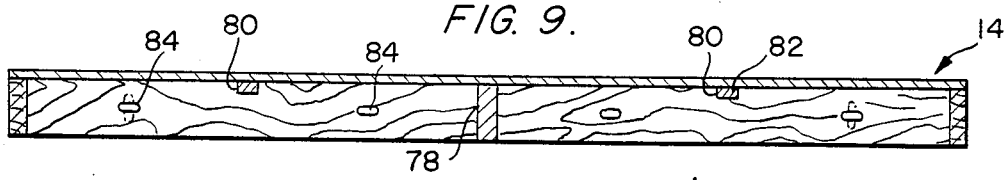
FIG. 9 is a section on line 9—9 of FIG. 8.

In initiating construction of the modular home, holes are dug in the soil to receive the footers 24 and the foundations with attached footers are erected and tied together with the wedge bars and wedges to form an interlocked foundation setting above the ground level. Thereafter, a plurality of block type footings designated 60, FIG. 1, are placed on 6' 8" intervals and support screw jacks 62 which screw jacks have top U shape members 64 which support 4"×4" timbers 68 with the top of the timbers mating with the top surface 38 of the ledges 36 in the foundation units. These 4"×4"'s support the ends of the modular floor panels as illustrated in FIGS. 1 and 5. With the 4"×4" beams 66 each end of a floor panel has support on either a ledge 38 or a 4×4 supported by the screw jacks 62. With the foundations 12 in place and with the 4×4's 66 in proper position, the structure is ready to receive the modular floor panel elements 14 to be described in reference to FIGS. 8 and 9 in conjunction with FIGS. 6 or 7.

Each floor panel 14 has finished dimensions of four feet by eight feet and the peripheral walls are preferably formed from 2"×6" wood boards 70 on the ends and 72 on the long edges. Further, each panel has a center element 76 also having a 2"×6" dimension and a cross beam 78 of similar stock. In addition longitudinal beams 72 and 76 are notched as at 80 to receive struts preferably cut from 1½"×1½" material and designated 82. Further, longitudinal beam 72 is provided with oblong openings 84 and 84' with openings 84 positioned 12 inches from the end members 70 and openings 84' twenty four inches on center. These openings 84 and 84' receive tie bars 32' having the oblong slots 90 in the ends thereof which oblong slots are shaped to receive the wedge lock pins 34.

The panel or module 14 is finish at the factory by nailing to its upper surface a cover sheet such as a ¾ inch particle board.

Figure 6:
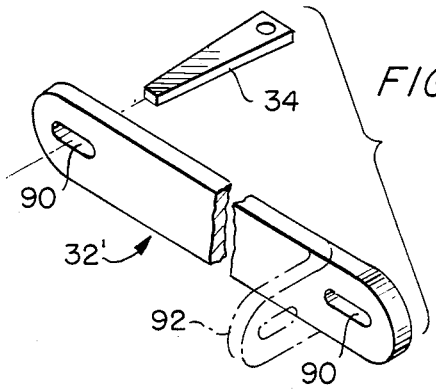
FIG. 6 is an exploded perspective view of preferred wedge lock type fastening means for the components.

In FIG. 6 the tie bar 32' is illustrated in two configurations, one where the entire bar is rectilinear and two wedge pins are used to lock the modular panels to one another and a form wherein end 92 is bent 90° so that only a single wedge pin 34 is needed. After placement of the panels on the support beams 66 and ledges 34 a locking bar 32 is inserted in each of the openings 84 and 84' in adjacent modules and then the panels are securely but releasably held together by the insertion of a locking pin 34 all as illustrated in the fragmentary view FIG. 7. The insertion of the locking bar 32' and the locking pins 34 is carried out beneath the floor in the "crawl space" created by the foundation walls, jacks 62, and beams 66.

Where desired the floor panels may receive conventional vapor barrier/insulation by stapling to the underside after the floor is installed at the building site.

Figure 10:
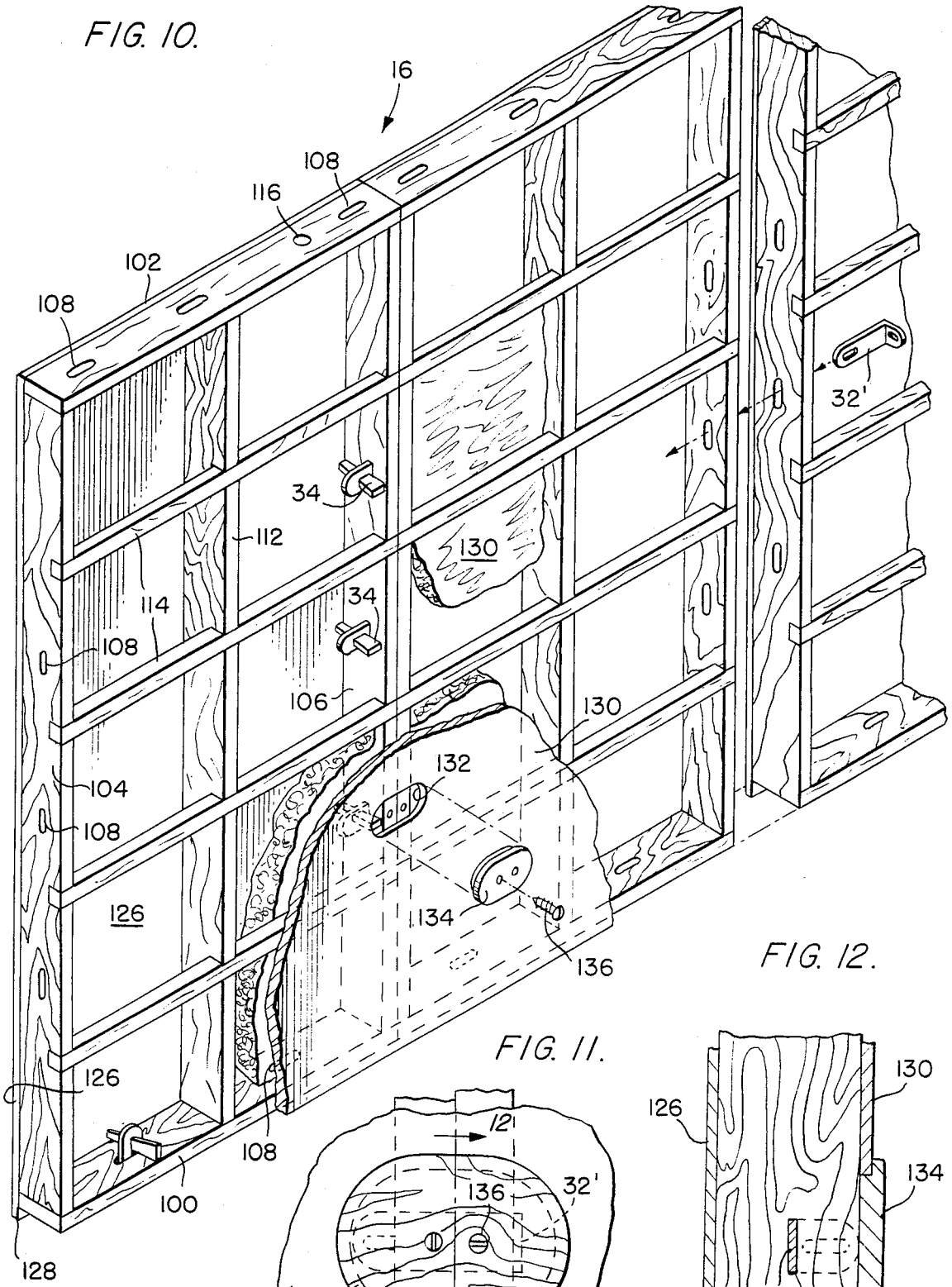
FIG. 10 is a partially exploded view of three modular wall panel units.
Figure 11:
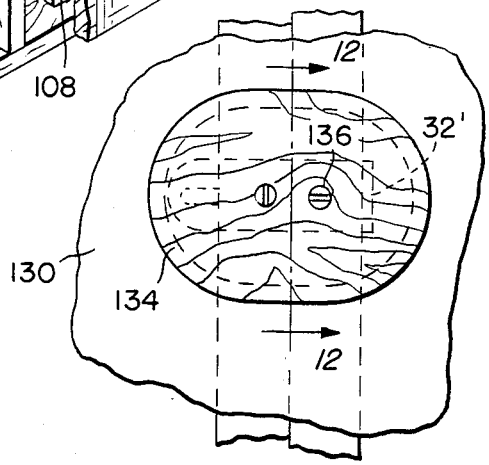
FIG. 11 is a fragmentary detailed view of one of the wedge lock assembling means for the wall panels of FIG. 10.
Figure 12:
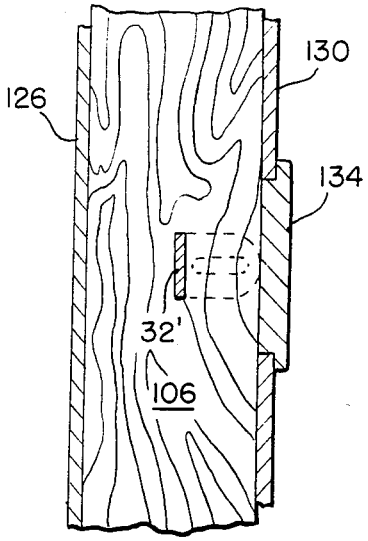
FIG. 12 is section on line 12—12 of FIG. 11.

Referring now to FIGS. 10, 11, and 12, a basic wall panel module 16 will now be described. Each wall panel module 16 is constructed of two inch by six inch boards with the panels having widths of 48" and heights of 7'11". The top and bottom boards 100 and 102 and the vertical side panels 104 and 106 are provided with oblong tie bar holes 108. In the illustrated form of the invention, there are two oblong tie bar holes at the bottom and three along the vertical edges and along the top. These oblong tie bar holes receive tie bars 32 or 32', previously described, and permit anchoring of the vertical members 104 and 106 to adjacent vertical members whereas the lower oblong holes 108 receive the upper ends 46 of the tie bars 42 anchored to the top surface 40 of the modular foundations as described in reference to FIGS. 2, 3, and 4. The top oblong holes 108 are employed to attach the top plate 110 to the structure, FIG. 1 of the drawing and to attach the roof trusses to be hereinafter described in reference to FIGS. 1, 15, 16 and 17.

As with the floor modules, the wall modules 16 include a center 2"×6" board 112 and a plurality such as four horizontal struts 114 which horizontal struts are received in slots cut in the vertical 2"×6"'s 104, 106 and 112. The struts 114 are, in the illustrated form of the invention, 1½ inches square in cross dimension and 48" long.

The panels are also provided with an opening 116 in the top 2"×6" 102 so that electrical wiring may be run interiorly of the wall panels of those panels which are to be provided with electrical outlet boxes such as electrical outlet boxes 118, FIG. 1 of the drawing. The panels illustrated in FIGS. 10, 11 and 12 are designated the basic wall panels and such wall panels are modified during construction to receive door and door openings 120 and window and window openings 122, FIG. 1 of the paragraph.

After the wall panel modules have been framed out and wired, an exterior sheet 126 is applied to one face which exterior sheet may be exterior grade plywood or the like or wire lathing may be attached to the exterior face where the exterior finish is to be a simulated brick or stucco. The exterior plywood or finish sheet 126 laps as at 128 the bottom 2"×6" 100 so that when the panels are installed a weather seal is provided along the marginal top edge of the foundation modules. After applying the exterior sheet insulation as illustrated at 130 is placed in the panels and an interior finish sheet such as wall board 132 is affixed to the inner surface of each panel.

Adjacent each opening 108 in each of the vertical elements 104 and 106, and the bottom and top boards 100 and 102, the interior wall board 130 is provided with an oblong opening 132 so that the panels may be assembled and wedge locked together by the tie bars such as tie bars 32' and their cooperating wedges 34. For each of the oblong openings 132 there is provided a cover plate 134 which is attached by screws such as screws 136 to complete the finish of the panels.

After the side wall units are installed, attached to adjacent panels and to the top surface of the foundation, a top plate 110 is provided for attachment to the tops of the wall panel and for attachment of the roof trusses. The top plate 110 comprises 2×6 boards which are provided with oblong openings corresponding to oblong openings 108 in the top board 102 of each side wall panel and with bores 150 corresponding to bores 116 for wiring connections.

The top plates are sized to end in the center of top board 102 of a panel except at the ends to provide greater rigidity in the finished housing. The top plate 110 is attached by special wedge lock brackets 160 FIGS. 15, 16, and 17 of the application.

Figure 15:
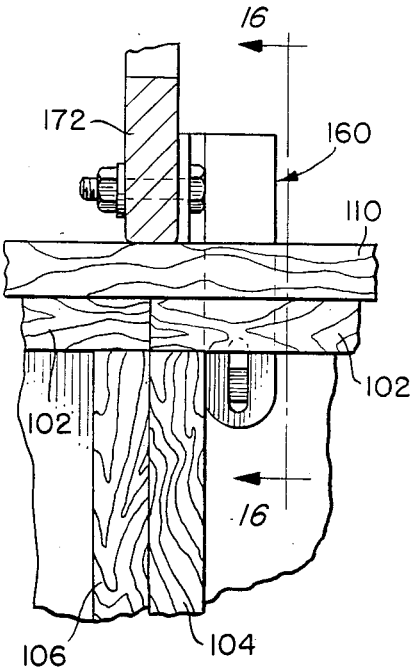
FIG. 15 is a fragmentary sectional view of means for attaching the roof joist or trusses to the top plate of the housing unit.
Figure 16:
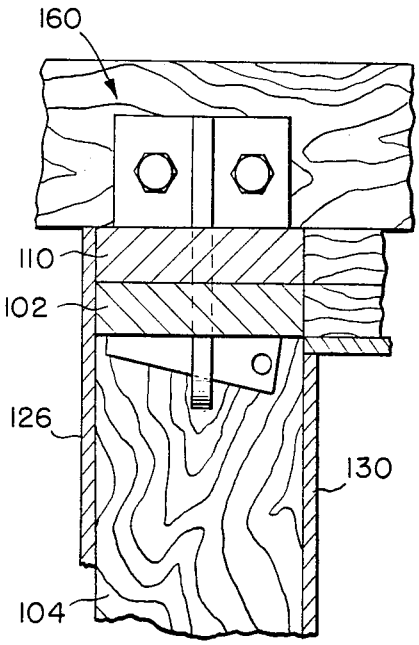
FIG. 16 is a section on line 16—16 of FIG. 15.
Figure 17:
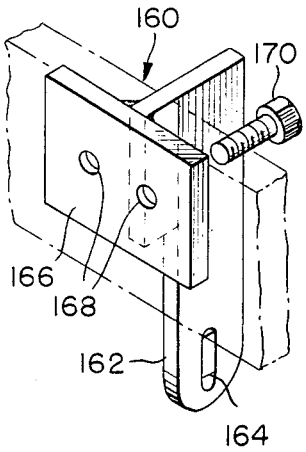
FIG. 17 is an enlarged fragmentary view of the truss or joist attaching means illustrated in FIGS. 15 and 16.

The brackets 160 comprise metal bars 162 having their lower ends provided with a locking wedge slot 164 and adjacent the upper end is welded a further plate 166, bored as at 168 to receive bolts 170 which bolts pass through the plates 166 and cooperating bores 172 in the trusses 118 as shown in FIGS. 1, 15 and 16. Thus each truss 18, the top plate 110 and each of the wall panel modules are integrally but releaseably joined via the brackets 160 and locking wedges 34.

Figure 13:
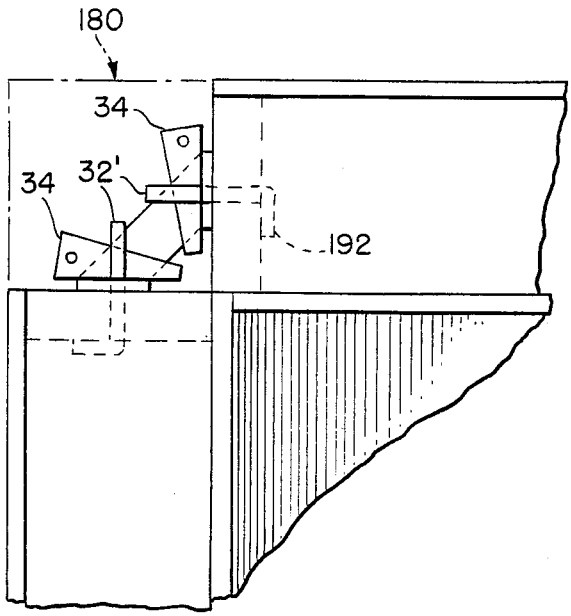
FIG. 13 is a fragmentary top plan view of corner reinforcing means for the housing system.
Figure 14:
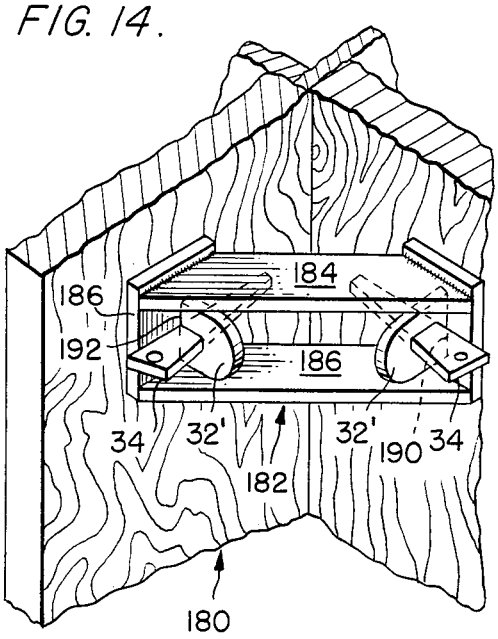
FIG. 14 is an end view of the structures illustrated in FIG. 13.

In order to provide greater stability for the housing at the corners 180, special corner brackets are applied after erection of the side walls. Referring now to FIGS. 13 and 14, the special corner brackets, generally designated 182 comprise top and bottom space plates 184 and 186 which are welded to end plates 188. The end plates 188 are slotted as at 190 to receive tie bars 32' and locking wedges 34. It has been found that three of these corner brackets corresponding to the three oblong slots provided in the basic wall panel modules provides the desired corner support. Where desired, trim strips may then be added to render the corners square.

After the trusses 18 are in place conventional roof finishing materials are added thereto such as external grade plywood and roofing shingles. Interiorly, wall board is added to the undersurface of the trusses.

From the foregoing description it will be seen that a modular housing construction is disclosed which will provide the low and medium priced purchaser a substantially completely finished home having the advantages of factory constructed durable modules at a minimum expense.

It will be evident to those skilled in the art that various modifications may be made in the modular house without departing from the spirit and the scope of the present invention as defined in the appended claims.

It will be further appreciated by those skilled in the art that while the housing is of very sturdy construction, if it becomes necessary to relocate the housing, substantially the entire house but for the roof and ceiling may be disassembled by removing the wedge lock pins and reassembled at another site at minimum expense.

What is claimed is:

1. A modular housing construction consisting of precast concrete footer/foundation components; a plurality of wooden modular floor panel elements; a plurality of wooden wall panel units and roofing trusses; preformed wedge/locks receiving openings in said floor panel elements, wall panels units, and foundation; preformed wedge lock operating openings in said pre-cast concrete footer/foundation components and in said wall panel units; windows in certain of the wall panel units, a door in certain other of the wall panel units, and electrical receptacles and wiring in selected wall panel units whereby erection and disassembly of said components, elements and units is minimized and quality is standardized; wherein the wedge/locks between said precast concrete footer/foundation components comprise bars having elongated openings at each end and a pair of co-operating wedge pins to be received in precast slots in said footer/foundation components; wherein the wedge/locks between adjacent wall panel units comprise wedge lock bars having a 90° bend at one end an elongated opening at the other end and a wedge pin receivable in said elongated opening; further wherein the wall panel units are provided with cover plates for the wedge lock openings therein; and further including a top plate releasable securable to the tops of the wall panel modules wherein wedge lock fitments secure the top plate to the tops of the wall panel modules and provide attaching means for the roof trusses.

2. The modular housing as defined in claim 1 wherein the pre-cast concrete footer/foundation components are provided with an integral ledge along the inner wall thereof and said integral ledge supports the modular floor panel elements.

3. The invention defined in claim 2 wherein interiorly of the modular footer/foundation components, the floor modulars are supported on beams supported on jacks engaging the ground.

4. The invention defined in claim 1 wherein adjacent wall panel modules at each corner are provided with metal braces anchored to said wall panel modules by wedge lock bars and pins.

* * * * *